US005402701A

United States Patent [19]

Ingram

[11] Patent Number: 5,402,701

[45] Date of Patent: Apr. 4, 1995

[54] DUAL ANGLE MITER AND GAUGE APPARATUS

[76] Inventor: Stanley J. Ingram, 5207 Cowden, Fort Worth, Tex. 76114

[21] Appl. No.: 167,170

[22] Filed: Dec. 16, 1993

[51] Int. Cl.[6] ..... B27B 27/06

[52] U.S. Cl. ..... 83/421; 83/435.1; 83/468; 83/468.3; 83/581; 269/304

[58] Field of Search ..... 83/421, 425, 435.1, 83/437, 468, 468.3, 468.7, 477.2, 522.18, 522.25, 581; 269/303, 304, 315, 319

[56] References Cited

U.S. PATENT DOCUMENTS

| | | | |
|---|---|---|---|
| 1,048,319 | 12/1912 | Knights | 83/435.1 |
| 3,830,127 | 8/1974 | James et al. | 83/435.1 |
| 4,079,648 | 3/1978 | Chappell | 83/490 |
| 4,111,409 | 9/1978 | Smith | 83/435.1 X |
| 4,122,739 | 10/1978 | Marlow | 83/468 X |
| 4,158,320 | 6/1979 | Kay | 83/425 |
| 4,165,668 | 8/1979 | McCord, Jr. | 83/435.1 |
| 4,441,394 | 4/1984 | Barsotti | 83/435.1 X |
| 4,464,962 | 8/1984 | Myhre | 83/477.2 X |
| 4,531,441 | 7/1985 | Bergler | 83/471.3 |
| 5,042,346 | 8/1991 | McCann | 83/421 |

*Primary Examiner*—Eugenia Jones

[57] ABSTRACT

A new and improved miter apparatus includes a base plate assembly which includes a front end, two sides, and a rear end. The base plate assembly includes a slot at the front end midway between the two side members for receiving a saw blade. A track assembly is located between the rear end and the slot on the base plate assembly. A carriage assembly is supported by the track assembly. The carriage assembly is capable of being moved back and forth along the track assembly. The carriage assembly includes a first pivot assembly and a second pivot assembly supported by the base plate assembly at a position between the track assembly and the slot on the base plate assembly. A pair of miter arms are pivotally connected to the second pivot assembly. The miter arms include respective third pivot assemblies supported by the miter arms. A pair of control arms are connected between the first pivot assembly and the respective third pivot assemblies, such that when the carriage assembly is moved along the track assembly toward the slot, the miter arms move such that respective miter angles between the slot and the respective miter arms decrease. Conversely, when the carriage assembly is moved along the track assembly away from the slot, the respective miter angles between the slot and the respective miter arms increase. A tongue assembly is attached to a bottom side of the base plate assembly and rides in a complementary slot in a table.

8 Claims, 2 Drawing Sheets

DUAL ANGLE MITER AND GAUGE APPARATUS

BACKGROUND OF THE INVENTION

1. Field of the Invention

The present invention relates generally to miters used for cutting materials with a power saw, and, more particularly, to a miter which includes an adjustable miter angle.

2. Description of the Prior Art

Power saws include table saws, radial saws, and band saws, and each of these types of saw is used for cutting materials such as wood and metal. When a material, such as a wooden board, is to be cut at an angle other than a right angle, a miter is often used. For a table saw and band saw, the board is placed against the miter, and the board and miter are moved toward the saw blade. Alternatively, for a radial saw, the board is placed against the miter, and the radial saw blade is moved toward the board and miter.

Throughout the years, a number of innovations have been developed relating to miters for power saws, and the following U.S. patents are representative of some of those innovations U.S. Pat. Nos.: 4,079,648; 4,158,320; 4,165,668; 4,531,441; and 5,042,346.

More specifically, U.S. Pat. No. 4,079,648 discloses a miter attachment for a portable electric circular saw. With this device, the miter is actually attached to the saw itself. As such, the saw becomes a heavier and more unwieldy tool. In this respect, it would be desirable if a miter device were provided for a power saw which is not directly attached to the saw itself.

U.S. Pat. No. 4,158,320 discloses a miter device that permits right and left cuts with a table power saw using a table that has two parallel grooves which straddle the miter device that rides in and that radiates from a respective groove. A problem with this device is that two grooves are necessary in the table for the saw. In this respect, it would be desirable if a miter device were provided which did not require two grooves in the table for the saw. Another problem associated with this device is that the miter devices radiates from a respective groove. The positioning of the miter device on a respective groove which is off to the side of the saw blade necessitates the need for the second groove and movement of the miter device for an opposite hand cut. In this respect, it would be desirable if a miter device were provided which did not ride in and radiate from a groove in a table of a saw.

U.S. Pat. No. 4,165,668 discloses a miter gauge for a table saw in which two grooves are provided which straddle the blade. Two separate guides are provided, one for right hand cuts, and one for left hand cuts. It would be desirable if the complexities and the expense of two separate guides could be avoided. In this respect, it would be desirable if a miter device were provided which avoids the use of two separate miter guides for right and left cuts.

U.S. Pat. No. 4,531,441 discloses a combination table and miter saw in which the saw and a miter are rotatable on a bearing assembly. Such an arrangement is complex and expensive and requires the combination to be made in a factory. Such a combination does not permit retrofitting a conventional table saw to have miter attachment. In this respect, it would be desirable if a miter device were provided which permitted a conventional table saw to be retrofitted with a miter attachment.

U.S. Pat. No. 5,042,346 discloses a miter attachment for a table saw that provides an invariable miter angle of 45 degrees. There are numerous application, however, in which a miter angle should be greater than or less than 45 degrees. In this respect, it would be desirable if a miter device were provided which permitted an adjustable miter angle in a range spanning from 0 to 90 degrees.

Still other features would be desirable in a miter and gauge apparatus for a power saw. For example, it is often desired that a right hand cut and a left hand cut be made at the same angle. In this respect, it would be desirable if a miter device were provided which readily provided for a fight hand cut and left hand cut to be made at the same angle.

When a miter and a board are moved toward a blade, it is important that the miter not get too close to the blade. Otherwise, the miter itself would be cut in addition to the board. In this respect, it would be desirable if a miter device were provided which included a stop assembly to prevent the miter from being cut by the saw blade.

When a specific angle of cut is desired, it is often necessary to employ a separate protractor to measure the angle that the miter is set to. In this respect, it would be desirable if a miter device were provided which included its own built-in protractor.

With different saws, distances between guide slots in the saw table and the saw blade itself vary. In this respect, it would be desirable if a miter device were provided which permitted the miter device to be adjusted to different distances between the table slot and the saw blade.

Thus, while the foregoing body of prior art indicates it to be well known to use miter devices for power saws, the prior art described above does not teach or suggest a miter and gauge apparatus which has the following combination of desirable features: (1) is not directly attached to the saw itself; (2) does not require two grooves in the table for the saw; (3) does not ride in and radiate from a groove in the table of the saw; (4) avoids the use of two separate miter guides for right and left cuts; (5) permits a conventional table saw to be retrofitted with a miter attachment; (6) permits an adjustable miter angle in a range spanning from 0 to 90 degrees; (7) readily provides for a right hand cut and left hand cut to be made at the same angular value; (8) includes a stop assembly to prevent the miter device from being cut by the saw blade; (9) includes its own built-in protractor; and (10) permits the miter device to be adjusted to different distances between the table slot and the saw blade. The foregoing desired characteristics are provided by the unique dual angle miter and gauge apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved miter apparatus which includes a base plate assembly which includes a front end, two sides, and a rear end. The base plate assembly includes a slot at the front end midway between the two side members for receiving a saw blade. A track assembly is located between the rear end and the slot on the base plate assembly. A carriage assembly is supported by the track assembly. The carriage assembly is capable of being moved back and forth along the track assembly. The carriage assembly includes a first pivot assembly and a second pivot assembly supported by the base plate assembly at a position between the track assembly and the slot on the base plate assembly. A pair of miter arms are pivotally connected to the second pivot assembly. The miter arms include respective third pivot assemblies supported by the miter arms. A pair of control arms are connected between the first pivot assembly and the respective third pivot assemblies, such that when the carriage assembly is moved along the track assembly toward the slot, the carriage assembly pushes the control arms which push the miter arms, whereby the miter arms move such that respective miter angles between the slot and the respective miter arms decrease. Conversely, when the carriage assembly is moved along the track assembly away from the slot, the carriage assembly pulls the control arms which pull the miter arms, whereby the miter arms move such that respective miter angles between the slot and the respective miter arms increase.

A tongue assembly is attached to a bottom side of the base plate assembly. The tongue assembly rides in a complementary slot in a table. The base plate assembly includes adjustment slots, and the tongue assembly includes connector assemblies for connecting the tongue assembly to the base plate assembly. The connector assemblies permit the tongue assembly to be adjusted laterally with respect to the base plate assembly.

A stop assembly is located at the rear end of the base plate assembly. The stop assembly is used for limiting movement of the base plate assembly on the saw table upon which the base plate assembly is placed. The stop assembly includes a stop element connected to the base plate assembly, and the stop element projects below the bottom side of the base plate assembly, such that the stop element bumps up against a side edge of the saw table when the base plate assembly is pushed sufficiently forward on the table. The stop assembly further includes an adjustable bracket which includes flanges. Complementary grooves are present in the base plate assembly for receiving the flanges of the adjustable bracket for guiding motion of the adjustable bracket along the base plate assembly.

Lock assemblies are connected to the base plate assembly for locking the adjustable bracket in a selected position on the base plate assembly. The adjustable bracket includes adjustment slots that permit adjustment of the adjustable bracket with respect to the lock assemblies.

A protractor assembly may be located on the base plate assembly and is positioned thereon such that a curved portion of the protractor assembly permits a determination of an angle between the respective miter arms. A zero position of the protractor assembly coincides with a pivot pin of the second pivot assembly.

The miter and gauge apparatus of the invention can have pilot holes for attaching added fences on the stop blocks for production runs.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved dual angle miter and gauge apparatus which has all of the advantages of the prior art and none of the disadvantages.

It is another object of the present invention to provide a new and improved dual angle miter and gauge apparatus which may be easily and efficiently manufactured and marketed.

It is a further object of the present invention to provide a new and improved dual angle miter and gauge apparatus which is of durable and reliable construction.

An even further object of the present invention is to provide a new and improved dual angle miter and gauge apparatus which is susceptible of a low cost of manufacture with regard to both materials and labor, and which accordingly is then susceptible of low prices of sale to the consuming public, thereby making such dual angle miter and gauge apparatus available to the buying public.

Still yet a further object of the present invention is to provide a new and improved dual angle miter and gauge apparatus which is not directly attached to the saw itself.

Still another object of the present invention is to provide a new and improved dual angle miter and gauge apparatus that does not require two grooves in the table for the saw.

Yet another object of the present invention is to provide a new and improved dual angle miter and gauge apparatus which does not ride in and radiate from a groove in the table of the saw.

Even another object of the present invention is to provide a new and improved dual angle miter and gauge apparatus that avoids the use of two separate miter guides for fight and left cuts.

Still a further object of the present invention is to provide a new and improved dual angle miter and gauge apparatus which permits a conventional table saw to be retrofitted with a miter attachment.

Yet another object of the present invention is to provide a new and improved dual angle miter and gauge apparatus that permits an adjustable miter angle in a range spanning from 0 to 90 degrees.

Still another object of the present invention is to provide a new and improved dual angle miter and gauge apparatus which readily provides for a right hand cut and left hand cut to be made at the same angular value.

Yet another object of the present invention is to provide a new and improved dual angle miter and gauge apparatus that includes a stop assembly to prevent the miter device from being cut by the saw blade.

Still a further object of the present invention is to provide a new and improved dual angle miter and gauge apparatus that includes its own built-in protractor.

Yet another object of the present invention is to provide a new and improved dual angle miter and gauge apparatus which permits the miter device to be adjusted to different distances between the table slot and the saw blade.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved dual angle miter and gauge apparatus embodying the principles and concepts of the present invention will be described.

Figure 1:
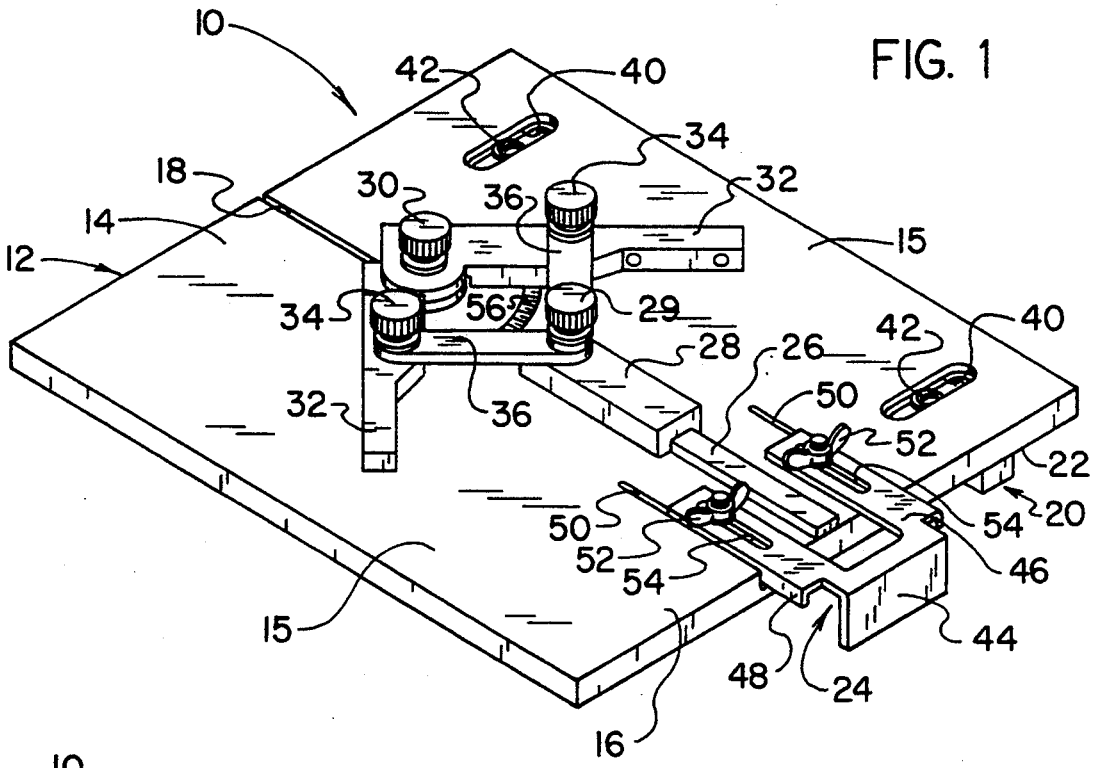
FIG. 1 is a perspective view showing a preferred embodiment of the dual angle miter and gauge apparatus of the invention.
Figure 2:
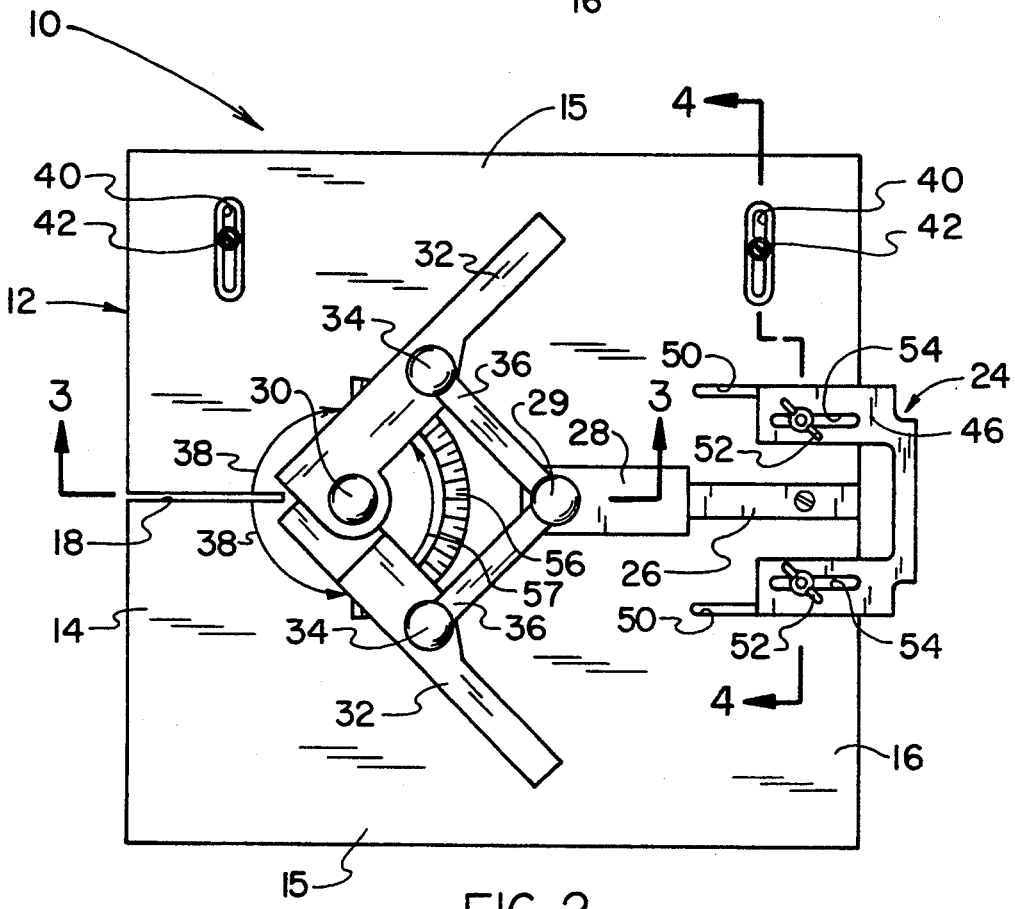
FIG. 2 is a top view of the embodiment of the invention shown in FIG. 1.
Figure 3:
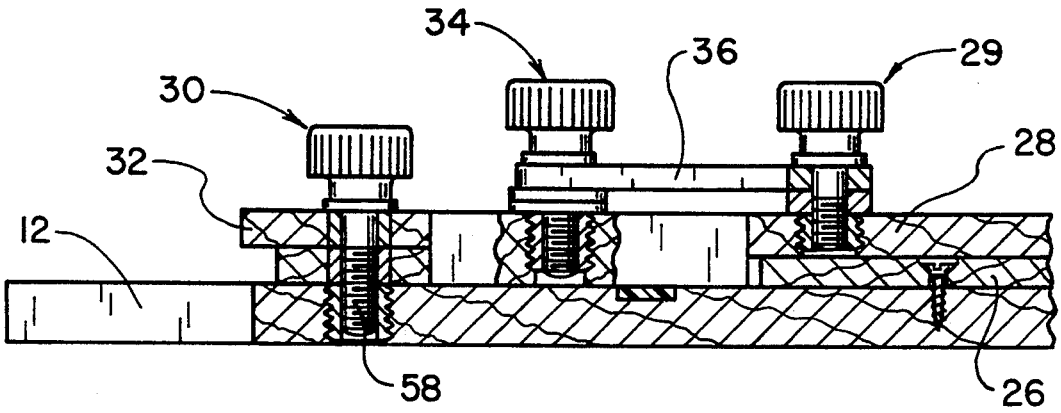
FIG. 3 is an enlarged, partial cross-sectional view of the embodiment of the invention shown in FIG. 2 taken along line 3—3 of FIG. 2.
Figure 4:
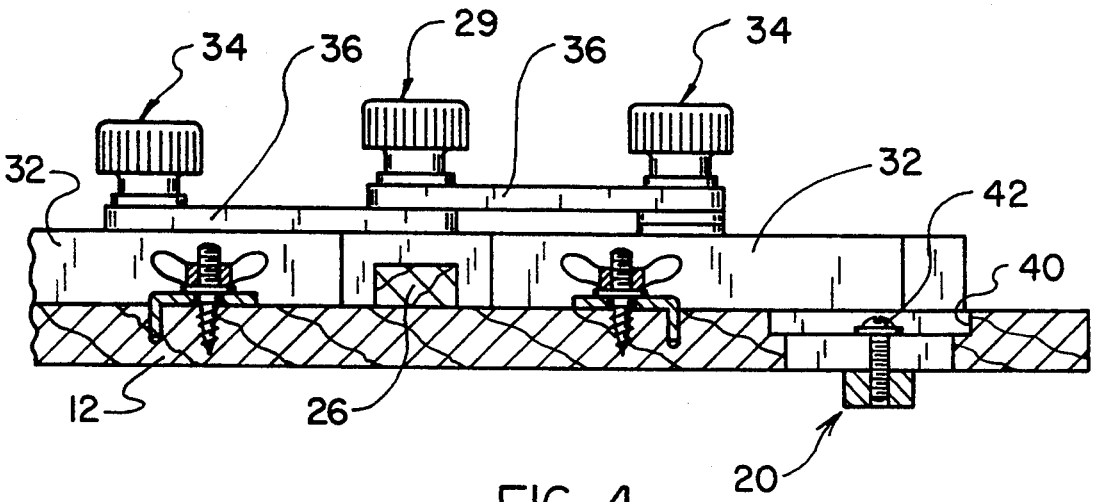
FIG. 4 is an enlarged, partial cross-sectional view of the embodiment of the invention shown in FIG. 2 taken along line 4—4 of FIG. 2.

Turning to FIGS. 1-4, there is shown an exemplary embodiment of the dual angle miter and gauge apparatus of the invention generally designated by reference numeral 10. In its preferred form, dual angle miter and gauge apparatus 10 includes a base plate assembly 12 which includes a front end 14, two sides 15, and a rear end 16. The base plate assembly 12 includes a slot 18 at the front end 14 midway between the two side members 15 for receiving a saw blade. A linear track assembly 26 is located between the rear end 16 and the linear slot 18 on the base plate assembly 12. The linear track assembly 26 and the linear slot 18 are colinear. A carriage assembly 28 is supported by the track assembly 26. The carriage assembly 28 is capable of being moved back and forth along the track assembly 26. The carriage assembly 28 includes a first pivot assembly 29 and a second pivot assembly 30 supported by the base plate assembly 12 at a position between the track assembly 26 and the slot 18 on the base plate assembly 12. A pair of miter arms 32 is pivotally connected to the second pivot assembly 30. The miter arms 32 include respective third pivot assemblies 34 supported by the miter arms 32. A pair of control arms 36 are connected between the first pivot assembly 29 and the respective third pivot assemblies 34, such that when the carriage assembly 28 is moved along the track assembly 26 toward the slot 18, the carriage assembly 28 pushes the control arms 36 which push the miter arms 32, whereby the miter arms 32 move such that respective miter angles 38 between the slot 18 and the respective miter arms 32 decrease. Conversely, when the carriage assembly 28 is moved along the track assembly 26 away from the slot 18, the carriage assembly 28 pulls the control arms 36 which pull the miter arms 32, whereby the miter arms 32 move such that respective miter angles 38 between the slot 18 and the respective miter arms 32 increase.

A tongue assembly 20 is attached to a bottom side 22 of the base plate assembly 12. The tongue assembly 20 rides in a complementary slot (not shown) in a table. The base plate assembly 12 includes adjustment slots 40, and the tongue assembly 20 includes connector assemblies 42 for connecting the tongue assembly 20 to the base plate assembly 12. The connector assemblies 42 permit the tongue assembly 20 to be adjusted laterally with respect to the base plate assembly 12.

A stop assembly 24 is located at the rear end 16 of the base plate assembly 12. The stop assembly 24 is used for limiting movement of the base plate assembly 12 on the saw table upon which the base plate assembly 12 is placed. The stop assembly 24 includes a stop element 44 connected to the base plate assembly 12, and the stop element 44 projects below the bottom side 22 of the base plate assembly 12, such that the stop element 44 bumps up against a side edge of the saw table (not shown) when the base plate assembly 12 is pushed sufficiently forward on the table. The stop assembly 24 further includes an adjustable bracket 46 which includes flanges 48. Complementary grooves 50 are present in the base plate assembly 12 for receiving the flanges 48 of the adjustable bracket 46 for guiding motion of the adjustable bracket 46 along the base plate assembly 12.

Lock assemblies 52 are connected to the base plate assembly 12 for locking the adjustable bracket 46 in a selected position on the base plate assembly 12. The adjustable bracket 46 includes adjustment slots 54 that permit adjustment of the adjustable bracket 46 with respect to the lock assemblies 52.

To use the stop assembly 24, the lock assemblies 52 are loosened, the adjustable bracket 46 is moved along its flanges 48 in the complementary grooves 50 in the base plate assembly 12 to a selected position for the stop element 44, and the lock assemblies 52 are retightened.

A protractor assembly 56 is located on the base plate assembly 12 and is positioned thereon such that a curved portion of the protractor assembly 56 permits a determination of an angle 57 between the respective miter arms 32. The protractor assembly 56 serves as a gauge for the respective angles of the miter arms 32. zero position of the protractor assembly 56 coincides with a pivot pin 58 of the second pivot assembly 30.

In using the miter apparatus 10 of the invention, the stop assembly 24 is adjusted as described above so that when the base plate assembly 12 is moved toward the saw blade as close as the stop assembly 24 will allow, the saw blade (not shown) will not penetrate beyond the slot 18 and cut the miter arms 32. The respective first pivot assembly 29, second pivot assembly 30, and third pivot assemblies 34 are loosened so that the carriage assembly 28 can be moved along the track assembly 26 to selectively push or pull the control arms 36 to adjust the miter angle 38 between the respective miter arms 32 and the slot 18. When the carriage assembly 28 is moved along the track 26, both miter arms 32 are moved simultaneously to provide the same miter angle 38 simultaneously. The protractor assembly 56 may be used to monitor the angle 57 between the miter arms 32. When the desired angles 38 and 57 are selected, the respective first pivot assembly 29, second pivot assembly 30, and third pivot assemblies 34 are retightened.

More specifically, the respective pivot assemblies includes knurled nuts and threaded bolts. The threaded bolts screw into wells in the base plate assembly 12 that have complementary threads to the threaded bolts. When the respective pivot assemblies are loosened, the respective threaded bolts are partially unscrewed from the respective threaded wells in the base plate assembly 12. Conversely, when the respective pivot assemblies are tightened to lock the miter arms 32, the control arms 36, and the carriage assembly 28 is proper position, the threaded bolts are turned to have them screw deeper into the threaded wells.

In addition, the miter and gauge apparatus of the invention can have pilot holes for attaching added fences on the stop blocks for production runs.

The components of the dual angle miter and gauge apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved dual angle miter and gauge apparatus that is low in cost, relatively simple in design and operation, and which may advantageously be used to provide a miter and gauge apparatus for a power saw which is not directly attached to the saw itself. With the invention, a dual angle miter and gauge apparatus is provided which does not require two grooves in the table for the saw. With the invention, a dual angle miter and gauge apparatus is provided which does not ride in and radiate from a groove in the table of the saw. With the invention, a dual angle miter and gauge apparatus is provided which avoids the use of two separate miter guides for right and left cuts. With the invention, a dual angle miter and gauge apparatus is provided which permits a conventional table saw to be retrofitted with a miter attachment. With the invention, a dual angle miter and gauge apparatus is provided which permits an adjustable miter angle in a range spanning from 0 to 90 degrees. With the invention, a dual angle miter and gauge apparatus is provided which readily provides for a right hand cut and left hand cut to be made at the same angular value. With the invention, a dual angle miter and gauge apparatus is provided which includes a stop assembly to prevent the miter device from being cut by the saw blade. With the invention, a dual angle miter and gauge apparatus is provided which includes its own built-in protractor. With the invention, a dual angle miter and gauge apparatus is provided which permits the miter device to be adjusted to different distances between the table slot and the saw blade.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A miter apparatus, comprising:

a base plate assembly which includes a front end, two side members, a bottom side, and a rear end, said base plate assembly including a linear slot at said front end midway between said two side members for receiving a saw blade, a linear track assembly located between said rear end and said slot on said base plate assembly wherein said track assembly is colinear with said slot, a carriage assembly supported by said track assembly, said carriage assembly capable of being moved back and forth along said track assembly, said carriage assembly including a first pivot assembly, a second pivot assembly supported by said base plate assembly at a position between said track assembly and said slot on said base plate assembly, wherein said position of said second pivot assembly is colinear with said slot and said track assembly, a pair of miter arms pivotally connected to said second pivot assembly, said miter arms including respective third pivot assemblies supported by said miter arms, and a pair of control arms connected between said first pivot assembly and said respective third pivot assemblies, such that when said carriage assembly is moved along said track assembly toward said slot, said carriage assembly pushes said control arms which push said miter arms, whereby said miter arms move such that respective miter angles between said slot and said respective miter arms decrease, and, conversely, such that when said carriage assembly is moved along said track assembly away from said slot, said carriage assembly pulls said control arms which pull said miter arms, whereby said miter arms move such that respective miter angles between said slot and said respective miter arms increase.

2. The apparatus described in claim 1, further including:

a tongue assembly attached to said bottom side of said base plate assembly, said tongue assembly for riding in a complementary slot in a table.

3. The apparatus described in claim 2 wherein:

said base plate assembly includes adjustment slots, and said tongue assembly includes connector assemblies for connecting said tongue assembly to said base plate assembly and for permitting said tongue assembly to be adjusted laterally with respect to said base plate assembly.

4. The apparatus described in claim 1, further including:

a stop assembly located at said rear end of said base plate assembly, said stop assembly for limiting movement of said base plate assembly on a table upon which said base plate assembly is placed.

5. The apparatus described in claim 4 wherein said stop assembly includes:

a stop element, connected to said base plate assembly, projecting below said bottom side of said base plate assembly, such that said stop element bumps up against a side edge of the table when the base plate assembly is pushed sufficiently forward on the table.

6. The apparatus described in claim 1, further including:

a protractor assembly located on said base plate assembly and positioned thereon such that a curved portion of said protractor assembly permits a determination of an angle between said respective miter arms, wherein a zero position of said protractor assembly coincides with a pivot pin of said second pivot assembly and wherein said zero position of said protractor assembly is colinear with said slot and said track assembly.

7. A miter apparatus, comprising:

a base plate assembly which includes a front end, two side members, a bottom side, and a rear end, said base plate assembly including a slot at said front end midway between said two side members for receiving a saw blade, a track assembly located between said rear end and said slot on said base plate assembly, a carriage assembly supported by said track assembly, said carriage assembly capable of being moved back and forth along said track assembly, said carriage assembly including a first pivot assembly, a second pivot assembly supported by said base plate assembly at a position between said track assembly and said slot on said base plate assembly, a pair of miter arms pivotally connected to said second pivot assembly, said miter arms including respective third pivot assemblies supported by said miter arms, a pair of control arms connected between said first pivot assembly and said respective third pivot assemblies, such that when said carriage assembly is moved along said track assembly toward said slot, said carriage assembly pushes said control arms which push said miter arms, whereby said miter arms move such that respective miter angles between said slot and said respective miter arms decrease, and, conversely, such that when said carriage assembly is moved along said track assembly away from said slot, said carriage assembly pulls said control arms which pull said miter arms, whereby said miter arms move such that respective miter angles between said slot and said respective miter arms increase, a stop assembly located at said rear end of said base plate assembly, said stop assembly for limiting movement of said base plate assembly on a table upon which said base plate assembly is placed, wherein said stop assembly includes:

a stop element, connected to said base plate assembly and protecting below said bottom side of said base plate assembly, such that said stop element bumps up against a side edge of the table when the base plate assembly is pushed sufficiently forward on the table, an adjustable bracket which includes flanges, complementary grooves in said base plate assembly for receiving said flanges of said adjustable bracket and for guiding motion of said adjustable bracket along said base plate assembly, and lock assemblies, connected to said base plate assembly, for locking said adjustable bracket in a selected position on said base plate assembly.

8. The apparatus described in claim 7 wherein said adjustable bracket includes adjustment slots that permit adjustment of said adjustable bracket with respect to said lock assemblies.

* * * * *